United States Patent [19]

Wolowski et al.

[11] Patent Number: 4,741,822

[45] Date of Patent: May 3, 1988

[54] PROCEDURE FOR HYDROGENATION OF COAL BY MEANS OF LIQUID PHASE AND FIXED-BED CATALYST HYDROGENATION

[75] Inventors: Eckard Wolowski, Muehleim; Rainer Löring, Bottrop; Frank Friedrich; Bernd Strobel, both of Essen, all of Fed. Rep. of Germany

[73] Assignee: Ruhrkohle Aktiengesellschaft, Essen, Fed. Rep. of Germany

[21] Appl. No.: 890,369

[22] Filed: Jul. 29, 1986

[51] Int. Cl.[4] ..... C10G 1/00; C10G 1/06

[52] U.S. Cl. ..... 208/412; 208/413; 208/417

[58] Field of Search ..... 208/412, 413, 415, 417

[56] References Cited

U.S. PATENT DOCUMENTS

| | | | |
|---|---|---|---|
| 3,726,784 | 4/1973 | Correa et al. | 208/412 |
| 4,152,244 | 5/1979 | Raichle et al. | 208/414 X |
| 4,330,391 | 5/1982 | Rosenthal et al. | 208/413 |
| 4,338,182 | 7/1982 | Vernon et al. | 208/412 |
| 4,400,261 | 8/1983 | Givens et al. | 208/412 X |
| 4,473,460 | 9/1984 | Küerten et al. | 208/413 |
| 4,602,992 | 7/1986 | Langhoff et al. | 208/417 X |

FOREIGN PATENT DOCUMENTS

| | | | |
|---|---|---|---|
| 3209143 | 9/1983 | Fed. Rep. of Germany | 208/418 |

*Primary Examiner*—Helen M. S. Sneed
*Assistant Examiner*—Glenn Caldarola
*Attorney, Agent, or Firm*—Oblon, Fisher, Spivak, McClelland & Maier

[57] ABSTRACT

Procedure for hydrogenation of coal by means of liquid phase and fixed-bed catalyst hydrogenation whereby the head products of the high-temperature separator are led directly, and together with the entire high-pressure circuit gas, over a reactor with a rigidly installed catalyst; are separated from the exhaust products of this reactor by partial condensation of the cycle oil required for producing the coal paste and withdrawn from an intermediate separator; and are led again, together with the entire high-pressure circuit gas, over an additional reactor with a fixed-bed catalyst.

6 Claims, 4 Drawing Sheets

PROCEDURE FOR HYDROGENATION OF COAL BY MEANS OF LIQUID PHASE AND FIXED-BED CATALYST HYDROGENATION

BACKGROUND OF THE INVENTION

1. Field of the Invention

The invention relates to a procedure for hydrogenation of coal by means of liquid phase and fixed-bed catalyst hydrogenation.

2. Discussion of the Background

DE-OS No. 26 54 635 discloses a procedure for leading a subset of the hydrogenated coal products, which leave the high-temperature separator as vapors and gases, over one or more reactors with a catalyst at a fixed location, to obtain refined oil products. This method of proceeding has the disadvantage that an input product consisting of light crude oil, medium oil, or heavy oil must be processed by the fixed-bed catalyst. Since coal oil fractions with a higher boiling point are generally much more difficult to refine than those with a low boiling point, the oil product thus obtained will show relatively high amounts of residual sulfur, oxygen and nitrogen compounds if the catalyst load is to be kept within economically manageable limits. Another disadvantage lies in the fact that this oil product consists in part of heavy oil while light crude and medium oils are generally desired for use or for further processing.

In another application of the procedure of DE-OS No. 26 54 635, the subset of vapors and gases from the high-temperature separator is made to be considerably larger than justified by the newly formed oil. A large part of the oil recycled for producing the coal paste is thereby also refined by hydrogenolysis at the fixed-bed catalyst. Unless corresponding additional reaction space with a catalyst is provided, the degree of refinement of the oil product is further reduced. By exchanging limit crude and medium oil for heavy oil, the boiling point of the oil product can be lowered in this process. However, this requires a considerable increase in machinery and power for the distillation steps and still does not improve the degree of refinement of the oil fractions.

Both applications of the DE-OS No. 26 54 635 procedure have the additional disadvantage that oils, regardless of their boiling points, must all be processed by the same catalyst, with the result that they are treated with medicore refining capabilities. However, a particularly intensive refinement and hydrogenation is generally desired, especially for the lighter fractions, in order to use them in reforming processes without additional hydrogenation step. At the same time, it is generally sufficient to hydrogenate the cycle oil for the coal paste and possibly also the medium oil part of the product with only moderate intensity, which permits a saving of hydrogen.

A procedure is disclosed in EPA No. 0 132 526 an intermediate separator operates directly behind the high-temperature separator from which the major part of the required cycle oil is removed. A second, smaller part is also produced in this procedure by treating the paste in a flash distillation system (flashing). The vapors and gases which are located behind the intermediate separator are led over a fixed-bed catalyst. For this reason, the oil product of the coal hydrogenation always consists of the oil fractions with the lowest boiling point. However, this process does not permit selective treatment of light and medium oil fractions either. Most important, however, in this process, just like in the first design application of the procedure of DE-OS No. 26 54 635, the cycle oil used for preparing the coal slurry is not refined by hydrogenation.

SUMMARY OF THE INVENTION

Accordingly, the object of the present invention is to provide a novel procedure for obtaining a high yield of hydrocarbon oil that is essentially free of oxygen, nitrogen and sulfur compounds.

This object and other objects which will become apparent from the following specification have been achieved by the present novel process of producing oil from coal by hydrogenation under pressure, in which the coal is stirred into a mixture with a distillate-type, continuously-recaptured solvent (lubricating oil, admixture oil, cycle oil) that can be pumped and, after addition of gas containing hydrogen, is reacted under pressures exceeding 100 bar and at temperatures between 450° and 500° C. within one or more reactors in the liquid phase (semi-solid phase). In this process, either a fine-grained catalyst is used which is constantly circulated through the reactor areas as part of the coal suspension, or a simmering catalytic bed is used, whereby the catalytic material is present in lumpy form in the reactor area. The reactor products are first separated in a high-temperature separator, just below the reaction temperature, into two separate flows consisting of semi-solid and head products.

The semi-solid product (residue) contains the solid parts of the coal which cannot be liguified and, possibly, the catalyst. In addition, the asphaltic, undistillable products of coal hydrogenation and small to medium amounts of distillable oil may be found in residues. This oil is recovered from the residue by distillation or other means, such as, for example, low-temperature carbonization, and used for producing the cycle oil. The low-oil-content residue is generally used as input material for production of hydrogen by suitable gasification processes.

The head product of the high temperature separator can, if required, also be led over a second high-temperature separator to separate solid pieces and asphalt particles which may have been swept along. The semi-solid product of the second high-temperature separator is then processed together with the residue of the first high-temperature separator or used directly for producing cycle oil. The head product of the high-temperature separators now free of solids and asphalt consists of vapor-like oils; heavy oil, boiling at normal pressure above 325° C.; medium oil, boiling at 200° to 325° C.; and light crude, boiling at up to 200° C. The head product also contains hydrogen and hydrocarbon gases, as well as small amounts of other substances such as water vapor and inorganic gases.

Surprisingly, it was found that even a moderately intensive refining with hydrogenation of the entire cycle oil or of the greater part of the cycle oil, leads to a considerable increase in oil yield in the coal hydrogenation reactor. In this process a particularly advanced refinement of the product oil can be achieved at the same time if the vaporous and gaseous products of the reactor are entirely, or in a large part, moderately refined during a first hydrogenation stage at a first fixed-bed catalyst. After condensing and separating the parts with higher boiling points (required for the cycle oil) in an intermediate separator, the parts which are still vaporous or gaseous are subjected to a second hydrogenation process by a second fixed-bed catalyst.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 represents an operational method of the inventive procedure with an intermediate separator installed between two fixed-bed reactors.

DETAILED DESCRIPTION OF THE PREFERRED EMBODIMENTS

Figure 1:
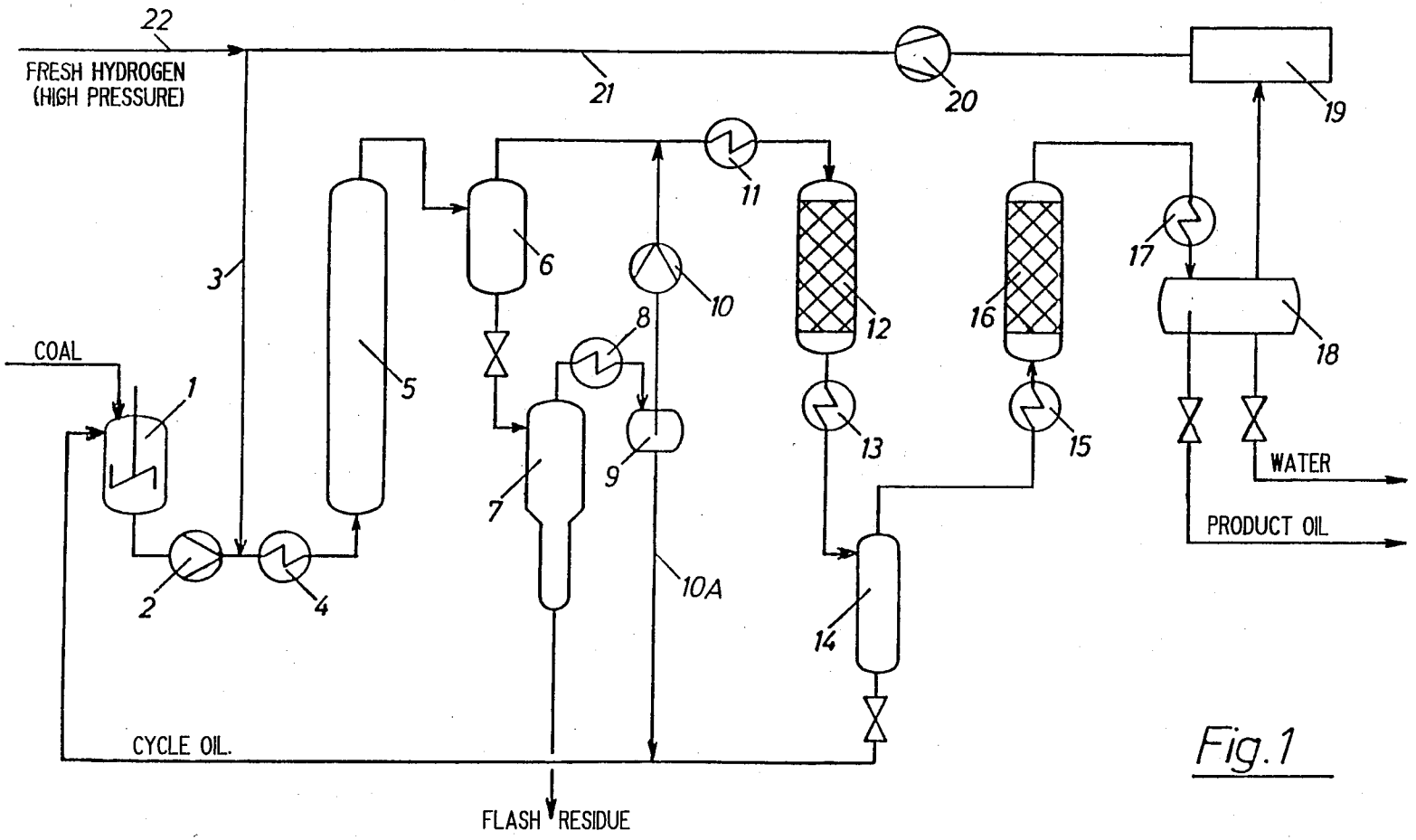
FIGS. 1–4 show conveyor lines of the inventive procedure and several modifications.

In the inventive procedure, cycle oil is obtained which is lighter in terms of density and boiling point than non-refined cycle oil. Only a minimal portion of the total vaporizable oil remains in the residue from which it is extracted. Generally, the temperature at the head of the high-temperature separator remains at at least 440° C. In this way, less than 25% of the cycle oil is obtained, or less than 20% of total evaporatable oil (product oil plus cycle oil).

Preferentially, the oil extracted from the residue should be pumped directly into high-pressure storage. In this regard both the injection into the hot head products of the high temperature separator and the injection prior to the first high-temperature separator can be used to control the entry temperature of the first fixed-bed reactor. In the latter case, the discernable heat of the products from the semi-solid reactor is sufficient to evaporate the residue oil.

It is possible to use the oil from the residue directly as cycle flow oil to produce the coal paste. However, the refining hydrogenation of this component is also preferred. In this manner the highest oil yield and the best degree of refinement of the product oil are obtained. According to a further embodiment of the inventive procedure, the oil from the residue can by hydrogenation-refined in a separate reactor outside the gas circuit, if an especially gentle procedural method is desired for the first fixed-bed reactor system. The pre-refined oil can then either be injected into the head product of a possible second high-temperature separator and thus be further refined at the first fixed-bed reactor system, or else it is used directly as the cycle oil fraction. In this case, the pre-refined oil can be preferentially fed into the system together with the accompanying gases and vapors before the pre-heater of the semi-solid phase, immediately after exiting from the special reactor. The discernible heat and the excess hydrogen are used in this process, and the carbon paste can be prepared to a correspondingly higher concentration.

A selective refinement for the generation of a light oil directly suitable for reformer utilization at relatively low hydrogen use can also be obtained. This is achieved according to a further embodiment of the invention, if after extraction of the cycle oil from the intermediate separator, a second intermediate separation at greatly reduced temperature is undertaken. In order to improve the precision of separation, a high-pressure fractionation column may be installed on the second intermediate separator. The separation line is set at approximately 185° C., so that a moderately refined but storage-stable medium oil is produced which can be used as heating oil, for example. The mixture of vapor and gases which exits from the fractionation column over head is fine-purified in the second fixed-bed reactor system after corresponding pre-heating. After cooling, a light oil (boiling point up to 185° C.) which has been virtually completely purified of hetero-atoms, is obtained from the low-temperature separator.

The inventive procedure has the following advantages in relation to the known procedure:

(i) In spite of the removal of oxygen and nitrogen from the product oil, no reduction in yield occurs, due to the simultaneously effected hydrogenating refinement of the cycle oil. On the contrary and surprisingly, a considerable increase in yield occurs.

(ii) It is possible to very extensively remove the hetero-atoms from the oil which has already been pre-refined in the first fixed-bed reactor, by means of the additional hydrogenation treatment of the product oil only in the fixed-bed reactor system which follows the intermediate separator.

(iii) The operation of the semi-solid phase reactor, the reactor for hydrogenation of cycle oil and the reactor for fine-refining of the product oil in a common high-pressure gas circuit saves a considerable number of devices and machines, as well as much energy, by comparison with the operation of separate high-pressure facilities. Since the oils are unstressed much less frequently, the solubility losses of pressure-hydrogen are less. The high-molecular weight compounds which are formed in the intermediate condensation of low-refined oils are strongly destructive of fixed-bed catalysts. For this reason, these oils usually require an additional intermediate treatment, i.e., by distillation. By contrast, in the inventive procedure an intermediate condensation is avoided. The oils for the most part arrive directly at the refining catalysts in vapor form and under hydrogen pressure. For this reason, the catalysts have a long life-span. The compounds of Fe, Co, Ni, W, Mo, Zn or Sn with oxygen or sulfur which are usual in carbon hydrogenation, or a combination of several of these compounds are used as catalysts.

Referring now to the drawings, wherein like reference numerals designate identical or corresponding parts, in a mixing facility 1, ground coal and possibly the catalytic mass is stirred to a paste with the oil from an intermediate separator 14. The relationship of coal (anaqueous) to oil may amount to between 1:0.8 and 1:3. Preferential ratios are between 1:1 and 1:1.5. The coal paste is moved against the operating pressure of the hydrogenation facility, which is more than 100 bar, and preferentially between 150 and 400 bar, by means of a pump 2. Hydrogenation gas, consisting of circuit gas (pipe 21) and hydrogen (line 22) is introduced by means of a pipe 3. The hydrogen content of the circuit gas (hydrogenation gas) should be above 50% by volume. Additionally, circuit gas is blown into the hydrogenation reactors 5, 12 and 16 at various levels and in the required quantities, in order to regulate the temperature. The total quantity of circuit gas, measured at the condensor 20, is between 1 and 8 standard cubic meters per kg of pure coal. The quantity of fresh hydrogen corresponds to the hydrogen usage, and is 700–1500 normal cubic meters per kg of coal utilized.

Coal paste and hydrogenation gas are heated in a preheater 4 and converted at temperatures between 450° C. and 500° C. in a semi-solid phase reactor 5. The reactor 5 may consist of one or several containers. If it is provided with a corrugated catalyst bed, the coal paste need contain no catalytic mass. In high-temperature separator 6, vapors and gases are separated from the liquid and solid matter (residue) at temperatures between 440° C. and 480° C., and are passed on overhead of the separator 6. The residue is unstressed and flashed in order to obtain the oils contained therein. The flash residue is either brought in directly by means of pipe 10A for producing the paste, or high-pressure pump 10 carries the flash oil to the vapors/gases from the high-temperature separator 6. The temperature of the mixture is regulated by heat exchanger 11 in such a way that the entry temperature in the reactor 12 obtains the desired value (between 350° C. and 420° C.).

Hydrogenation and refining catalysts of the type usually used in processing of coal oils and petroleums are used as catalysts in the reactors 12 and 16. In this process, the same or different catalysts can be used in the reactors 12 and 16 in order to obtain favorable results for the particular end product in regard to the particular coal used, in terms of degree of refining, satiation, splitting and hydrogen consumption.

The vapors/gases from the reactor 12 are cooled in heat exchanger 13 to such a degree that a quantity of oil equal to what is used in the production of the coal paste is continually condensed. This cycle oil is unstressed from an intermediate separator 14 and fed back to the mixing facility 1. The required temperatures for the intermediate separator 14 are between 250° C. and 350° C.

The vapors and gases which exit from the intermediate separator 14 are heated to the entry temperature of the fixed-bed reactor 16 (350°–420° C.) by means of a heat exchanger and, if necessary, by means of additional temperature regulation. The product oil is separated out of the mixture of vapors and gases by cooling to temperatures below 50° C. in a heat exchanger 17. In addition, hydrogenation water, containing ammonia and hydrogen sulfide, condenses at this point. These liquids are unstressed in a low-temperature separator 18, and passed on to further processing or utilization.

At the head of the low-temperature separator, a gas mixture is drawn off which consists largely of hydrogen and hydrocarbon gases, but which also contains hydrogen sulfide, ammonia and small quantities of oxides of carbon. In high-pressure gas rinser 19, this gas is purified to the required degree and enriched with hydrogen. A circuit condensor 20 carries the circuit gas back to the hydrogenation reactor.

Figure 2:
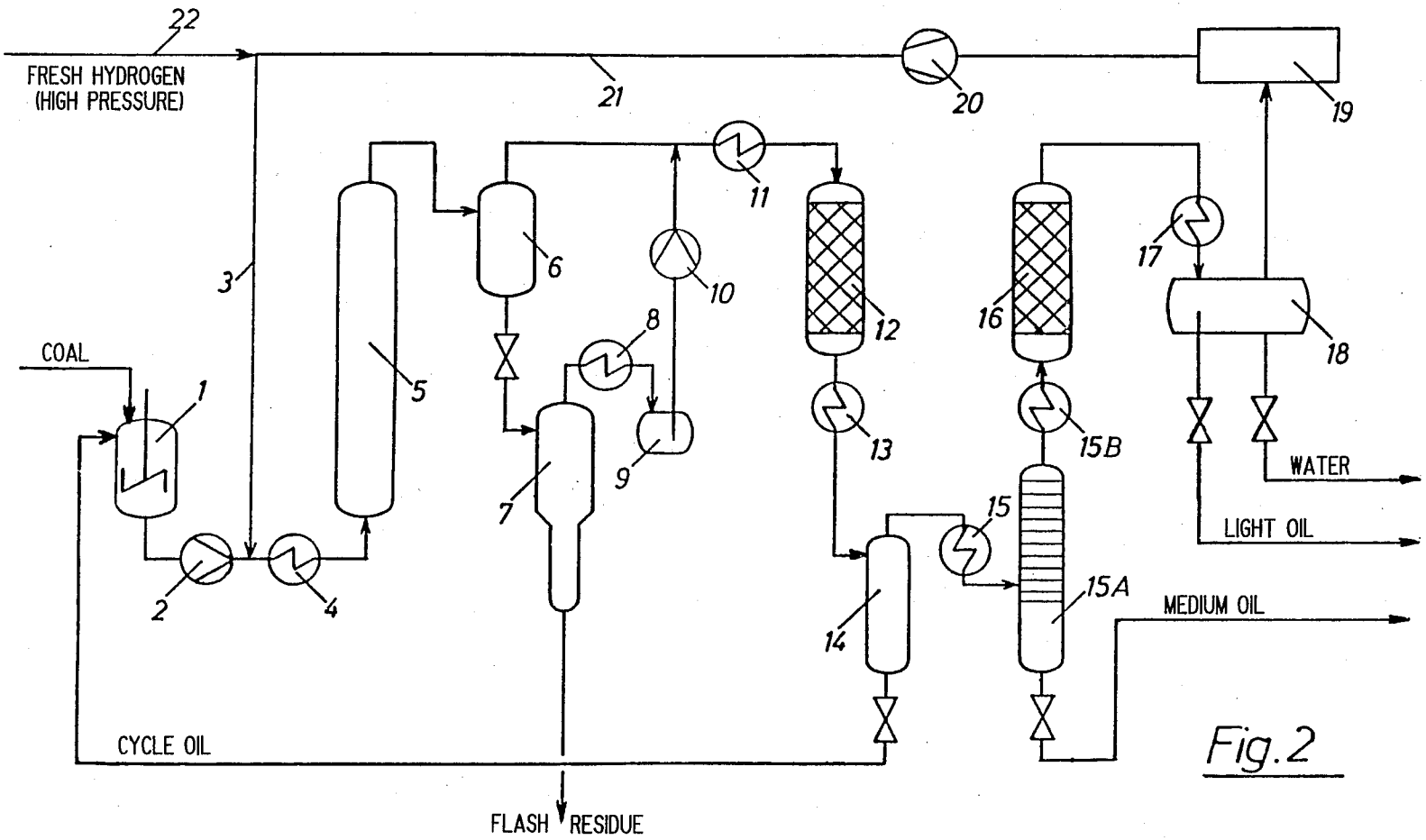

FIG. 2 shows an embodiment of the inventive procedure with two intermediate separators 14 and 15 between the two fixed-bed reactors 12 and 16. This method of operation is advantageous if only the light-oil portion of the product oil needs to be extensively refined while the medium oil portion can be used further as a storage-stable, moderately refined product. As has already been described, the cycle flow oil is obtained from th vapor/gas mixture behind the reactor 12. The head product from the intermediate separator 14 is cooled in the heat exchanger to such a degree that essentially medium oil (boiling point between 185° and 325° C.) is extracted from the second separator 15A. This intermediate separator 15A may be equipped with fillers or other additions for improving separation precision, after the manner of the distillation column. The vapors and gases drawn off at the head of the separator and/or the column are brought to the temperature of the fixed-bed reactor (350°–420° C.) in a heat exchanger 15B. By means of this method, an oil is obtained from the low-temperature separator 18 which consists largely of light oil (final boiling at 185° C.), and is of reformer utilization quality.

Figure 3:
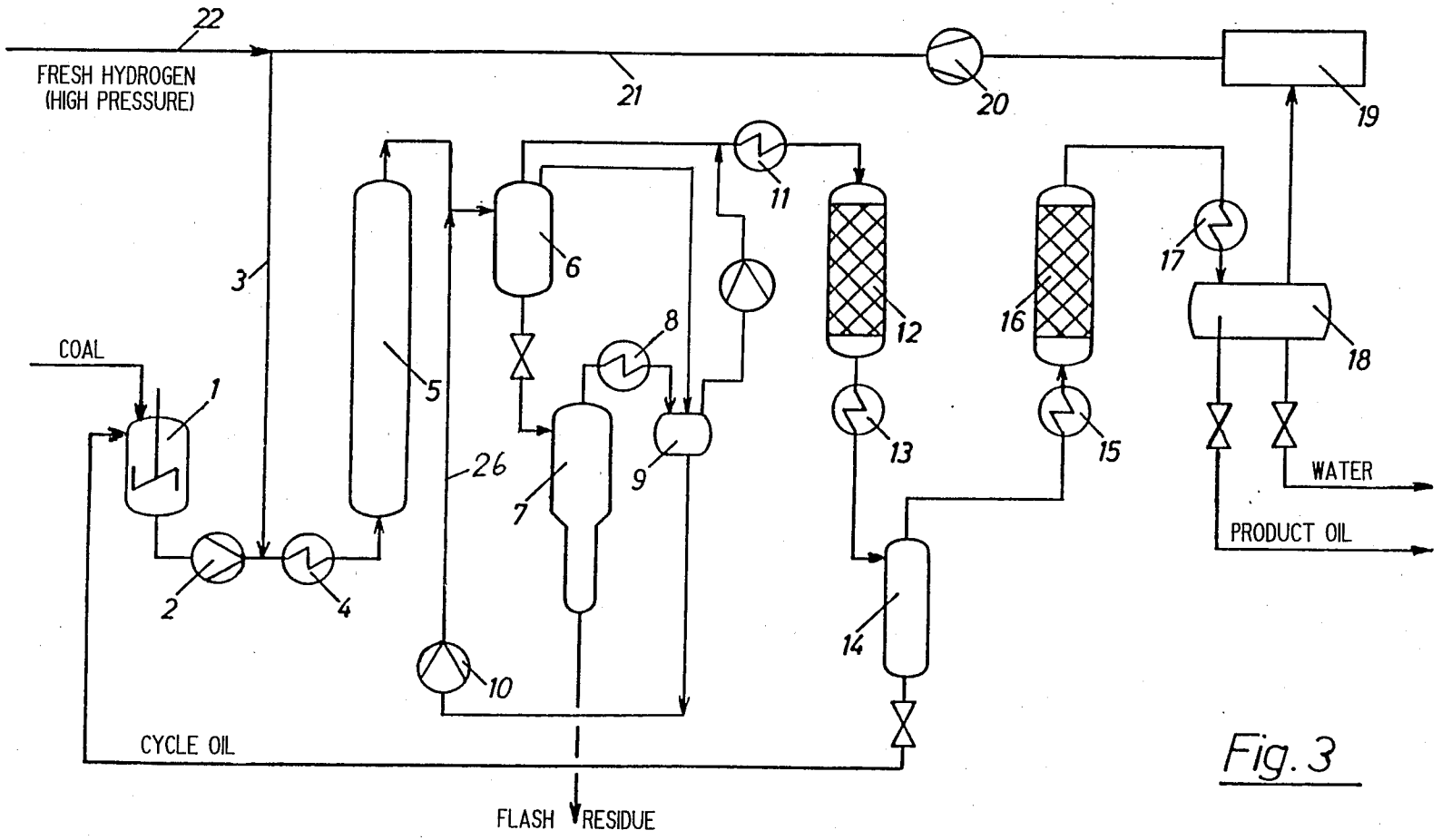

FIG. 3 shows another embodiment of the inventive procedure. In this method, the distillate from the flash facility 7 is injected with the aid of pump 10, through pipe 26, into the hot products of the semi-solid phase reactor 5, prior to the entry of the latter into the high-temperature separator. The heat required for the evaporation of the flash oil in this process is obtained from the products of the semi-solid phase reactor 5.

Figure 4:
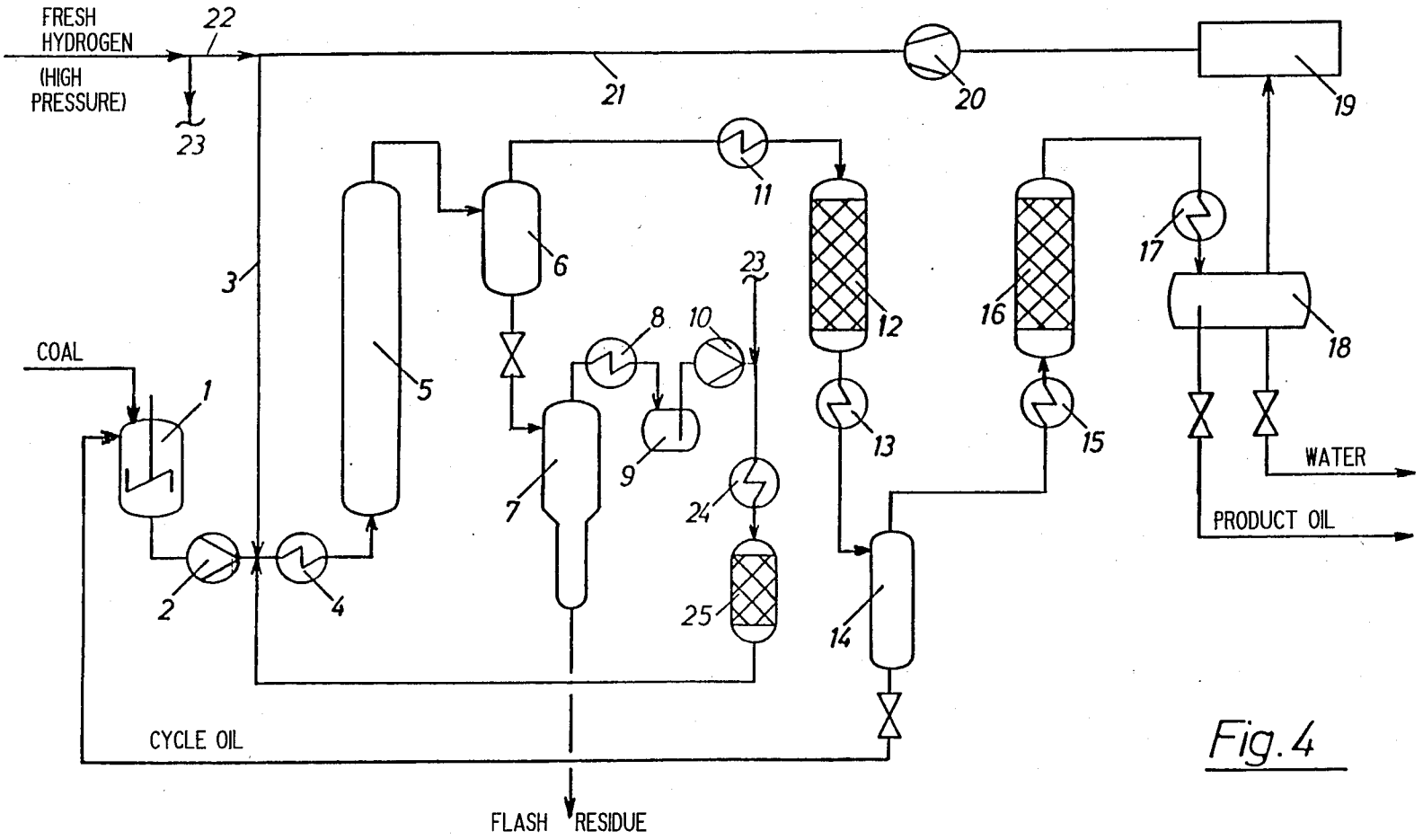

FIG. 4 shows an embodiment of the inventive procedure in which an additional reactor 25 is installed outside the common gas circuit. According to this method, the flash oil is heated in a heat exchanger/preheater 24 after having hydrogen or a gas containing hydrogen added to it by means of a pipe 23, and is then hydrogenated in a fixed-bed reactor 25 at 350°–420° C. under approximately the same pressure as in the other reactors. In this regard, around 0.5–5 $m^3$/kg of hydrogen are added to the flash oil. The total exit product of the reactor 25 is passed through pipe 26 to the coal paste before the preheater 4, which is already under pressure. The solid-matter content of the coal paste produced in the mixing facility 1 is set correspondingly higher than in the other methods. The hydrogen not used in the reactor 25 is fully available for the semi-solid phase hydrogenation. The fresh hydrogen addition through pipe 22 can therefore be correspondingly reduced.

Within the framework of the inventive procedure, combinations of the embodiments described are also possible. Thus, for example, the method according to FIG. 2 can be correspondingly adapted as per FIG. 1. In addition, further embodiments are possible. For instance, the products of the fixed-bed reactor 25 (method according to FIG. 4) could also be added at a different point in the hydrogenation facility, e.g., after the high-temperature separator 6 or after the fixed-bed reactor 12.

Other features of the invention will become apparent in the course of the following descriptions of exemplary embodiments which are given for illustration of invention and are not intended to be limiting thereof.

EXAMPLES

Example 1

In a facility according to FIG. 1, 126 kg of anaqueous gas-flame coal (120 kg/hr, calculated water and ash-free) where mixed every hour with 5 kg of dried red mass and 134 kg/hr of cycle oil, to form a paste, and fed, together with 650 $m^3$/hr of hydrogenation gas (gas guantity under standard conditions) consisting of 150 $m^3$/hr of fresh hydrogen and 500 $m^3$/hr of circuit gas (containing 60% by vol. hydrogen), through a semi-solid phase reactor 5. The pressure in the reactor was 400 bar and the temperature 470° C. The temperature in the vapor chamber of the high-temperature separator 6 was kept at 440° C. The residue from the high-temperature separator 6 was subjected to an unstressing vaporization (flashing) in a vacuum. This produces 24 kg/hr of flash oil, which was used without any further treatment to produce the cycle oil. The entire head product of the high-temperature separator 6 was fed through the fixed-bed reactor 12 which contains 80 kg of a commercially familiar catalyst made of sulfides of nickel and molybdenum on an $Al_2O_3$-$SiO_2$ carrier. The mean catalyst temperature was 380° C.; the pressure was 400 bar. The exiting products were cooled to 275° C. In this process, 110 kg/hr of liquid oil were generated, which were drawn off from the intermediate separator 14 and united with the flash oil from the pipe 10A. The cycle oil thus generated contained 38% heavy oil (boiling point above 325° C. and 62% medium oil. The head products of the intermediate separator 14 were fed through the fixed-bed reactor 16, which was filled with 80 kg of a commercially familiar catalyst consisting of molybdenum sulphide and nickel sulfide on a clay carrier. The mean catalyst temperature was 390° C. and the pressure was 400 bar. By cooling to 20° C., 65 kg/hr (54% of the waf-coal) of water-transparent product oil, was condensed and passed out of the low-temperature separator. The product oil contained 20 mg/kg of basic nitrogen and 50 mg/kg of phenolic oxygen. After 1 month of storage in an air-and light-free environment, the oil was slightly yellowish. The oil yield was higher, and at the same time, the oil quality was considerably better than with coal hydrogenation without integrated refining stages.

Example 2 method of Example 1 was followed. All the cycle oil was obtained from the intermediate separation.

In a facility according to FIG. 1, 106 kg of dry gas-flame coal (100 kg/hr, calculated water and ash-free) were mixed every hour with 4 kg of dried red mass and 154 kg/hr of cycle oil to form a coal paste and fed, together with 625 $m^3$/hr of hydrogenation gas consisting of 125 $m^3$/hr of fresh hydrogen and 500 $m^3$/hr of circuit gas (containing 80% by vol. hydrogen), through a semi-solid phase reactor 5, with a capacity of 200 l. The pressure in the reactor was 300 bar and the temperature was 470° C. The temperature in the high-temperature separator 6 was kept at 440° C. The residue from the high-temperature separator 6 was subjected to an unstressing vaporization (flashing) in a vacuum. This produced 21 kg/hr of distilate, which was pumped in front of the entry of the fixed-bed reactor 12. In addition, the entire head product of the high-temperature separator 6 was fed through reactor 12. Reactor 12 contained 80 kg of a commercially familiar refining catalyst based on nickel, molybdenum and clay. The mean catalyst temperature was 390° C. The products exiting from reactor 12 were cooled to 290° C., yielding 154 kg/hr of oil which was drawn off from the intermediate separator 14. The oil was continually fed back for the purpose of making the coal paste.

The cycle oil thus generated contained 30% heavy oil (boiling point above 325° C.) and 70% medium oil (boiling point up to 325° C.). The gases and vapors drawn off at the head of the intermediate separator 14 were fed through the fixed-bed reactor 16, which was likewise filled with 80 kg of a commercially familiar catalyst, based on molybdenum, nickel and $Al_2O_3$. The mean catalyst temperature was 390° C. and the pressure was 400 bar. By cooling the reactor output products to 20°, 55 kg/hr of water-transparent product oil, consisting of 40% light oil and 60% medium oil, were passed out of the low-temperature separator. After one month, the oil was still colorless. The product oil contained only 6 mg/kg of basic nitrogen and less than 15 mg/kg of phenolic oxygen. Thus, the oil yield was 55%, and the oil quality was good.

Example 3

The method according to Example 2 was followed, with an additional intermediate separator.

An experiment was conducted under the same conditions as in Example 2. However, the vapors and gases were passed over head of the intermediate separator 14 at 290° C., cooled to 170° C. and fed into the output part of a high-pressure-resistant packed column 15A with some 25 theoretical plates at a liquid load of 20 l/hr. Twenty-three kg/hr of medium oil in the boiling-point range of 175°-325° C. were unstressed from the semi-solid in the column. The vapors and gases drawn off at the column head at 160° C. were heated and passed over the fixed-bed reaotor 16. The reactor 16 contained 50 kg of a commercially familiar Ni-Mo-$Al_2O_3$ refining catalyst. The mean temperature of the catalytic bed was kept at 375° C. The reactor output products were cooled to 20° C. yielding 22 kg/hr of light oil with a final boiling point of 185° C. from the low-temperature separator.

The medium oil contained 0.06% basic nitrogen and less than 0.1 oxygen. After 1 month in storage under air- and light-free conditions, the oil was the color of yellow straw. It had formed no sediment. The light oil contained less than 1 mg/kg each of titratable nitrogen and oxygen. After one month of storage it remained transparent as water.

Example 4

The method according to FIG. 3 was followed.

In a hydrogenation similar to FIG. 3, 100 kg of a gas-flame coal (calculated water and ash-free) were passed every hour, together with 4 kg/hr of dried red mass and 154 kg/hr of cycle oil, through the semi-solid phase reactor 5, with a capacity of 200 l. In addition, 550 $m^3$/hr of circuit gas (80% hydrogen) and 125 $m^3$/hr of fresh hydrogen were fed in. The reactor exit products were broken down in high-temperature separator 6 at 450° C. into a liquid residue and a vapor/gas stream which was drawn off over head. The latter was then immediately passed over a smaller second high-temperature separator 9 at 445° C.

From the residue of the high-temperature separator 6, 18 kg/hr of flash oil was distilled off in a vacuum-unstressing facility 7. This fraction was united with the residue (2 kg/hr) of the second high-temperature separator 9 which consisted largely of oil, and was pumped through pipe 26 into the reactor output products, before the latter reached the high-temperature separator 6.

The head products of the second high-temperature separator 9 were fed into the reactor 12 at 380° C. over 80 l of a Ni-Mo-clay catalyst. After cooling to 280° C., 15 kg/hr of oil were produced in the intermediate separator 14, which were used to produce coal paste. The head product stream from the intermediate separator 14 was heated to 390° C. and passed at 400° C., over 80 of a Co-Mo-$Al_2O_3$ catalyst in the reactor 16. After cooling, 54 kg/hr of product oil with a basic nitrogen content of 10 mg/kg and a phenolic oxygen content of 15 mg/kg were obtained from the low-temperature separator 18. The oil consisted of 45% light oil, the rest being medium oil. After 1 month in storage, a pale yellow discoloration of the initially water-transparent oil had occurred.

Example 5

The method according to FIG. 4 was followed.

In a hydrogenation facility corresponding to FIG. 4, a hydrogenation experiment with subbituminous coal was undertaken. Here, 109 kg/hr of an anaqueous coal (corresponding to 100 kg/hr of coal calculated water- and ash-free) was mixed with 4 kg/hr of red mass and 87 kg/hr of cycle oil, to form a suspension which was continually passed by means of the high-pressure pump 2 to the preheater 4. From the preheater 4, circuit gas containing 85% by vol. of hydrogen was introduced in a quantity of 150 $m^3$/hr. In addition, the hot liquid and gaseous products from the fixed-bed reactor 25, which was filled with 25 kg of a Ni-Mo catalyst on a clay carrier, were mixed into the coal paste prior to the preheater. In the reactor 25, the entire flash oil fraction (25 kg/hr) was treated with 125 $m^3$/hr of fresh hydrogen at a temperature of 385° C. and at a pressure of 152 bar. The semi-solid phase reactor 5 had a volume of 200 l and was operated at a temperature of 458° C. and a pressure of 150 bar. The products were broken down at 450° C. in the high-temperature separator 6, into a liquid residue and a stream of vapors and gases, which, after cooling to 370° C., were passed through the reactor 12 with an 80 kg catalyst fixed-bed. The catalyst was a commercially familiar hydrogenation catalyst consisting of sulfides of tungsten and nickle on clay carriers. The pressure in the reactor was 150 bar and the temperature was 390° C. The products of the reactor 12 were cooled to 330° C. yielding 87 kg/hr of a medium/heavy oil mixture from the following intermediate separator 14, all of which was used as cycle oil.

The residue from the high-temperature separator 6 yielded 25 kg/hr of flash oil When treated in the flash-vaporizer. The residue was then sulfated by saturation with hydrogen sulfide gas, subsequently hydrogenated and further used as described above.

The vaporous/gaseous head product of the intermediate separator was heated to from 350° C. to 370° C. and passed through a reactor with an 80 kg solid Ni-Mo-$Al_2O_3$ catalyst, whereby the pressure remained at 150 bar, and the temperature was set at 375° C. After cooling of the reactor products to 20° C., 56.5 kg/hr of product oil were obtained from the low-temperature separator, consisting of 60% medium oil and 40% light oil. The basic nitrogen content was 8 mg/kg and the phenolic oxygen content was approximately 15 mg/kg. After one month under air- and light-free conditions, the oil continued to be water-transparent.

Example 6

This is a comparative example without refining of the cycle oil and the product oil.

An experiment was conducted as in Example 2. However, the facility contained neither a fixed-bed reactor 12 after the high-temperature separator 6, nor a fixed-bed reactor 16 after the intermediate separator 14. The fresh hydrogen quantity was 100 $m^3$/hr. The hourly quantity of distilled oil from the unstressed vaporization of the residue was 30 kg. Every hour, 124 kg of oil were obtained from the intermediate separator 14 by cooling of the vapors from the high-temperature separator 8 to 300° C. This oil was mixed with the residue distillate and continually fed back for coal paste production. The cycle oil contained 45% medium oil, the rest being heavy oil. Every hour, 49.5 of product oil were obtained from the low-temperature separator 18 which consisted of 23% light oil and 77% medium oil. The basic nitrogen content of the oil was 0.76% and the phenolic oxygen content was 2.7%. After one month, the oil, which was initially yellowish, was black in color. Thus, without refining of the cycle oil and the product oil, a lower yield was obtained, and the oil quality was significantly lower.

Example 7

This is a comparative Example in which only the product oil was refined.

An experiment was conducted as in Example 6. However, after the intermediate separator 14, a fixed-bed reactor 16 with 160 kg of catalyst was used. The fresh hydrogen quantity was 125 $m^3$/hr.

Every hour, 48.5 of water-transparent and storage-stable oil were obtained from the low-temperature catalyst 19. It consisted of 42% light oil and 58% medium oil. The basic nitrogen content was 12 mg/kg. The oil quality was thus similar, but the yield was considerably lower than with the inventive procedure.

Example 8

This is a comparative example in which all of the oil was refined.

In an experiment similar to Example 2, the first fixed-bed reactor 12 contained 160 kg of catalyst and the second fixed-bed reactor was not operated. The fresh hydrogen quantity was 125 $m^3$/hr and the hourly quantity of residue distillate was 20 kg. The oil yield from the low-temperature separator 18 was 55 kg/hr. The oil consisted of 36% light oil and 64% medium oil with a nitrogen content of 100 mg/kg. After one month, the originally colorless oil was colored yellow. In terms of the state of the art, the yield from this method was good. However, the oil quality was insufficient.

Obviously, numerous modifications and variations of the present invention are possible in light of the above teachings. Therefore it is to be understood that within the scope of the appended claims, the invention may be practiced otherwise as specifically described herein.

What is claimed as new and desired to be secured by Letters Patent of the United States is:

1. A process for the hydrogenation of coal by catalytic liquid phase and catalytic fixed-bed hydrogenation, comprising:

(I) preparing a pumpable coal slurry from ground coal and asphalt-free cycle oil which is recovered from the process.

(II) adding hydrogen-containing recycle gas and make-up hydrogen to the coal slurry, (III) reacting the coal slurry with the hydrogen-containing gas in a liquid phase reactor in the presence of a catalyst under high temperature and pressure, (IV) separating the gaseous and vaporous reaction product from the liquid and solide products obtained in step (III) with at least one high-temperature, high-pressure separator.

(V) detaining an asphalt-free distillate oil by flashing the stream of liquid and solid products from the high-distillation step, (VI) hydrogenating the entire high-temperature, high pressure separator overhead stream of step (V) in a fixed-bed reactor, (VII) feeding the hydrogenation product of step (VI) to an intermediate temperature, high-pressure separator to obtain (1) cycle oil and (2) vaporous and gaseous materials, (VIII) feeding the cycle oil obtained from the said intermediate temperature separator of step (VII) to the slurry preparation of step (I).

(IX) hydrogenating the vaporous and gaseous materials obtained from said intermediate, separator of step (VII) in a second fixed-bed reactor to obtain a product oil, and (X) separating circuit gas from said product oil in a low-temperature separator;

wherein 75 to 100 percent of the cycle oil required for step (I) is obtained from the said intermediate temperature, high-pressure separator of step (VII) and up to 25 percent of the cycle oil is obtained by flash distillation of the residue of the said high-temperature separator, said process comprising hydrogenating cycle oil obtained from the residue of said high-temperature separator in an additional fixed-bed reactor, and feeding back the entire head product from said additional fixed-bed reactor to the product obtained in adding step (I).

2. The process of claim 1, wherein said coal hydrogenation step (iii) is performed at a pressure greater than 100 bar and at temperatures between about 450° and 500° C.

3. The process of claim 1, wherein said head product hydrogenating step (vi) is performed at the same pressure at said coal hydrogenating step.

4. The process of claim 1, wherein said cycle oil obtained from the residue of said high-temperature separator is fed back prior to said first high-temperature reactor.

5. The process of claim 1, further comprising:

(a) partially condensing the head products of the said intermediate temperature, high-pressure separator of step (vii) in a second intermediate temperature, high-pressure separator arranged in series downstream the said intermediate temperature, high-pressure separator;

(b) drawing-off a partially refined medium oil from the said intermediate temperature, high-pressure separator; and (c) drawing-off reformer-use quality light oil from the said second intermediate temperature, high-pressure separator.

6. The process of claim 1, comprising, in step (X), condensing and separating said circuit gas from said product oil in a low-temperature separator.

* * * * *